US008813967B2

(12) United States Patent
Plant et al.

(10) Patent No.: US 8,813,967 B2
(45) Date of Patent: Aug. 26, 2014

(54) ADJUSTABLE MILL CLASSIFIER

(75) Inventors: Robert Plant, Nottingham (GB); Mike Godwin, Derby (GB); Christopher Daniel Curl, Branford, CT (US)

(73) Assignee: ALSTOM Technology Ltd, Baden (CH)

( * ) Notice: Subject to any disclaimer, the term of this patent is extended or adjusted under 35 U.S.C. 154(b) by 21 days.

(21) Appl. No.: 13/462,208

(22) Filed: May 2, 2012

(65) Prior Publication Data

US 2013/0292304 A1 Nov. 7, 2013

(51) Int. Cl.
*B07B 4/00* (2006.01)

(52) U.S. Cl.
USPC ..... 209/139.1; 241/119

(58) Field of Classification Search
USPC ..... 209/134–138, 139.1, 140–143, 713, 209/714; 241/117–121
See application file for complete search history.

(56) References Cited

U.S. PATENT DOCUMENTS

| | | | | |
|---|---|---|---|---|
| 4,693,811 | A | 9/1987 | Lohnherr | |
| 4,750,677 | A * | 6/1988 | Taylor | 241/5 |
| 5,055,182 | A | 10/1991 | Lohnherr | |
| 5,090,631 | A * | 2/1992 | Wark | 241/119 |
| 5,184,730 | A | 2/1993 | Paul | |
| 5,957,300 | A | 9/1999 | Nardi et al. | |
| 6,409,108 | B1 * | 6/2002 | Wark et al. | 241/119 |
| 7,156,235 | B2 * | 1/2007 | Eisinger | 209/138 |
| 2006/0118673 | A1 | 6/2006 | Wark | |
| 2009/0065403 | A1 * | 3/2009 | Ito | 209/139.2 |

FOREIGN PATENT DOCUMENTS

| | | |
|---|---|---|
| DE | 10 2004 019109 | 12/2005 |
| EP | 0 172 731 | 2/1986 |
| JP | 2009-034560 | 2/2009 |
| JP | 2011-255368 | 12/2011 |
| WO | 99/55463 | 11/1999 |

* cited by examiner

*Primary Examiner* — Joseph C Rodriguez
*Assistant Examiner* — Kalyanavenkateshware Kumar

(57) ABSTRACT

A classifier [100] is disclosed that employs adjustable vanes [140] that may be interactively adjusted to change the distribution of fuel particle sizes that are passed on to a furnace. The classifier employs a frame [133] having a plurality of windows [131] each having an adjustable vane [140]. A control ring [160] is rotated with respect to the frame [133] to simultaneously move links [150] connected between the control ring [160] and the vanes [140]. This causes the vanes [140] to open or close, changing the air flow path and changing the size distribution of particles passing through the classifier [100] to the furnace. The system may include an adjustment system [260] that can automatically sense particle size to optimize several physical parameters related to particle size.

13 Claims, 4 Drawing Sheets

ADJUSTABLE MILL CLASSIFIER

BACKGROUND

The present disclosure generally relates to an adjustable classifier that can adjust the size of particles separated in a solid fuel mill.

Power plants employ solid fuel furnaces in boilers for various purposes, such as for generating steam to create electric power.

The solid fuel, typically coal, is pulverized into a powder that is blown into the furnace to be burned. Mills (or pulverizers) are used to pulverize coal into powder. The mills typically create a distribution of particles sizes. However, for combustion, particles above a given size do not completely burn and therefore, fuel is wasted.

However, if all particles are pulverized to a very fine size, energy required to pulverize the particles is wasted. Also, the throughput of mill particles drops significantly when all particles are required to be very small. This would then require additional mills, which can become very expensive.

Therefore, there is a tradeoff of particle size in which balances the amount of coal that will be unburned vs. the throughput requires to efficiently run the boiler.

The particle size chosen is determined on how long it takes to burn the particle and how much unburned fuel is acceptable.

The particles are blown through the furnace and based upon their speed have a limited time in the furnace to burn. The rate of burning is related to the mass of the fuel to be burned, the surface area of the particles, the energy of the furnace flames, the water content and the type of fuel used. If all of these factors are fixed and the classifier is designed to separate particles with a size corresponding to these factors, the system runs well. However, if one or more of these factors changes necessitating different sized particles to be used, conventional classifiers are not easily modified to separate different sized particles.

Currently, there is a need for an adjustable classifier that can adjust the particles size distribution that is allowed to exit the mill and is fed to the boiler.

A classifier system 100 for separating coarser particles from finer particles entrained in an upward air stream is described having:

a housing 110 having a general circular cross section;

a truncated cone 120 inside of the housing 110 having a larger section at its top and a small cone outlet 230 at its bottom, the cone 120 defining an inner chamber 125;

an outer chamber 190 between the housing and the cone 120 adapted to receive coarser and finer particles entrained in the upward air stream;

a classifier ring 130 at the top of the cone 120 having a frame 133 with a plurality of windows 131 with vanes 140 hinged adjacent to each window 131; wherein the vanes 140 are adjustable to partially or fully close the windows 131 thereby affecting the size of particles allowed through them and into the inner chamber 125;

a fuel tube outlet 240 above the classifier ring 130 adapted to allow the air stream to exit the classifier system 100.

The invention may also include:

an adjustment system 260 having:

at least one pressure sensor 263 upstream of the classifier ring 130 to measure air pressure entering the classifier ring 130;

at least one pressure sensor 261 downstream of the classifier ring 130 to measure air pressure exiting the classifier ring 130;

a coarseness sensing device 269 adapted to sense particle size exiting the fuel tube outlet 240; and a control unit 265 adapted to receive signals from the sensors and calculate a vane 140 setting.

The disclosure may be understood more readily by reference to the following detailed description of the various features of the disclosure and the examples included therein.

BRIEF DESCRIPTION OF THE DRAWINGS

Referring now to the figures wherein the like elements are numbered alike:

FIG. 3 is a perspective view of the classifier ring of FIG. 2; an

DETAILED DESCRIPTION

Theory

Figure 1:
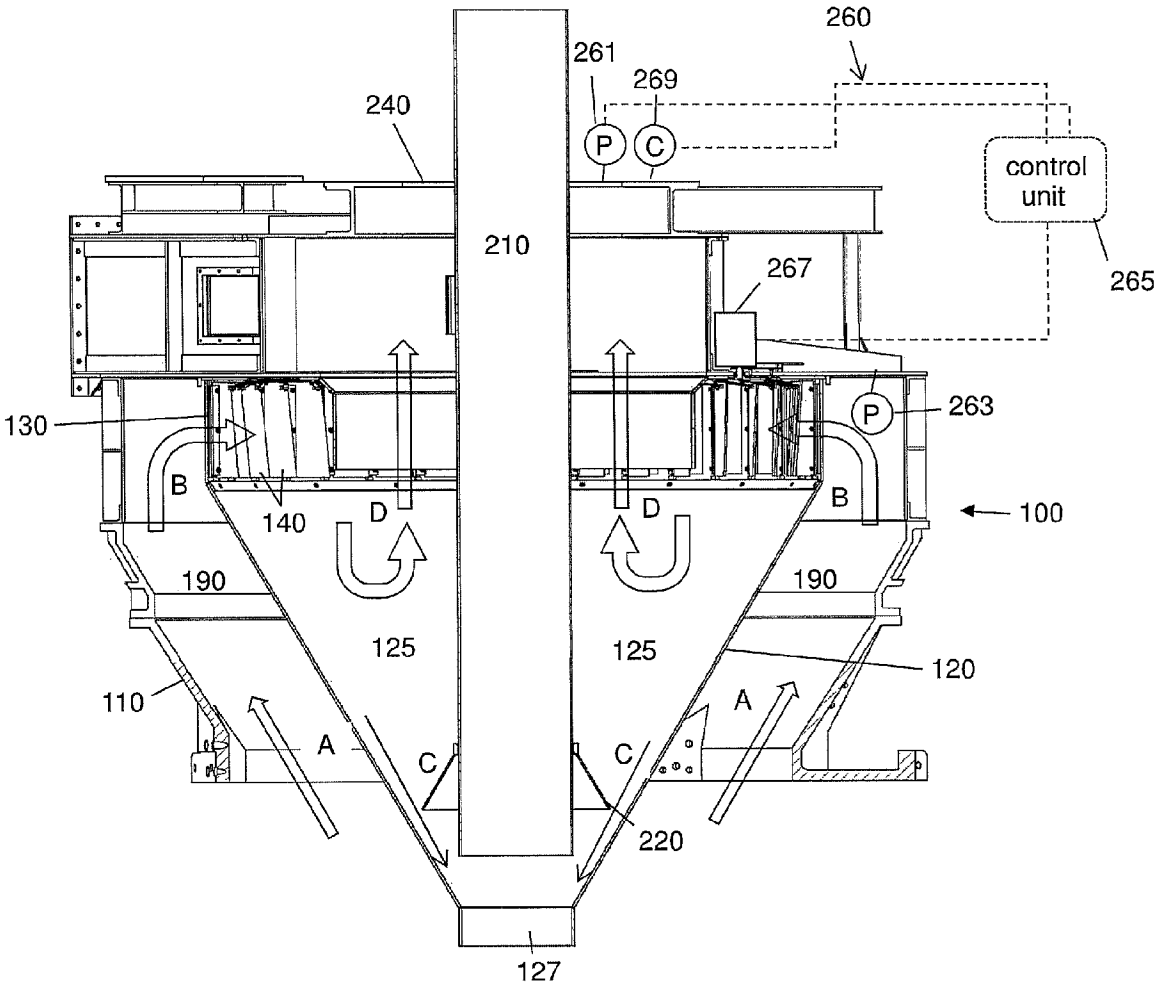
FIG. 1 is an elevational view of one embodiment of a classifier according to the present invention, as it appears in a mill.

The force on a particle by flowing air is proportional to its drag coefficient in the direction of the flow. Gravity also applies a force to the particles in a downward direction. Since the particles are entrained in a stream of air and are moving at a speed in a direction they have momentum.

For example, If the stream changes direction, there is a force, proportional to the drag coefficient directing the particle in the new direction. If two particles having similar drag coefficients but significantly different masses are in entrained in the same stream of air, and the stream changes directions, there is a similar force exerted on both particles. Assuming that the mass of a first particle was small enough to have a small momentum that was easily diverted by the force and its velocity was redirected into the new direction of the stream. However, assuming the second particle has more mass and more momentum and therefore, the force only partially diverts the velocity of the second particle.

If the stream changed its direction to go around a solid barrier, it is possible that the second particle was not redirected enough to avoid the barrier, and impacted the barrier. In this case, it imparts most of its velocity energy to the barrier and either slows or bounces. In either case, it is probably outside of the airstream and therefore, gravity will pull it downward to the pulverizer.

If the heavier second particle, was diverted enough to miss the barrier, but directed to an outer portion of the airstream, it will then fall out of the airstream. Typically, the periphery of airstreams have slower moving air. Since drag force that entrains particles is a velocity-dependent force, there may not be enough force to keep the particle entrained and, again the second particle falls downward out of the stream.

It was initially assumed that the drag force of both particles was similar. Even though heavier particles are typically larger, the drag force does not increase in the same proportions as the mass. Therefore this assumption is valid.

As the radius of curvature of the airstream having entrained particles becomes smaller, the average size of particles remaining entrained is also smaller.

Mill product classification is achieved by exposing the air/coal flow to radial acceleration as it passes through the vanes of the classifier. Larger particles possessing greater momentum are unable to pass through the contorted flow path and are returned to the table for further grinding while fine particles exit the classifier entrained with the primary air.

If a classifier is designed to reject all particles except those of a very small size, the larger particles are blown up to the classifier, are rejected and fall back to the pulverizer. This may happen many times, increasing the energy required to produce a required amount of fuel for a furnace.

However, if the particles provided to a furnace are too large, they do not fully burn and result in unburned carbon in the ash, making it unsuitable for the manufacture of concrete.

Finer particles yields improvements in combustion efficiency and reduces the amount of unburned carbon. This indirectly results in a reduction of NOx emissions.

Therefore, there should be a tradeoff of these constraints to determine the particle size used.

Therefore the ability to adjust the classifier blades while the mill is in service allows for its performance to be optimized.

This present invention relates to certain new and useful improvements in a classifier, more particularly a classifier of the cyclone type adapted to be used in direct communication with a mill or pulverizer to divide the finer sufficiently pulverized material from the coarser material which is returned to the mill for further grinding.

DETAILED DESCRIPTION

Figure 2:
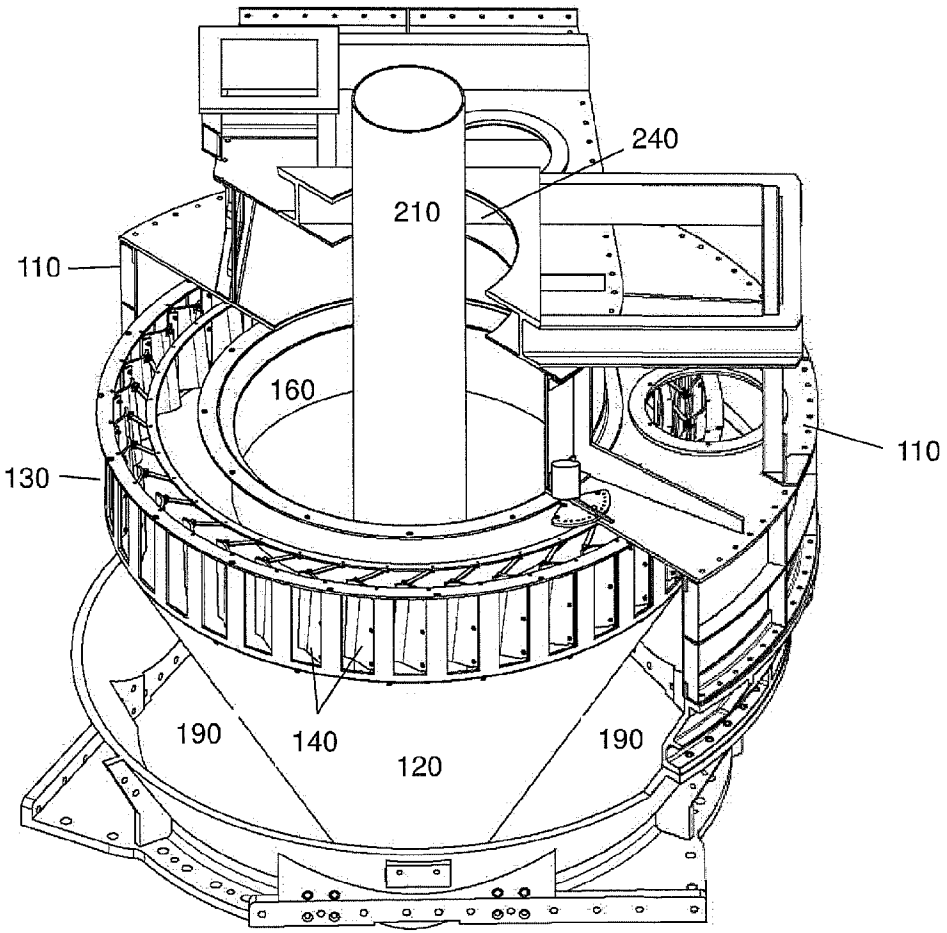
FIG. 2 is a partially cut-away, perspective view of the classifier of the present invention, as it appears in a mill.

Referring now to FIGS. 1 and 2, coal is provided to a mill (not shown) where the coal is ground, through a feed pipe 210. The classifier 100 is designed to receive a mix of coarse and fine particles entrained in an upward air stream from a mill below (not shown). The particles and air stream, indicated by arrows "A" are blown upward in an outer chamber 190 formed between an outer housing 110 and an inner cone 120.

The air stream and entrained particles enters a classifier ring 130 by blowing past vanes 130, past a flow diverter 250 and into an inner chamber 125, inside of cone 120.

Due to the turns of the air stream, heavier particles drop out of the stream and slide down the inside of cone 120 to cone outlet 127 and back to the grinding table of the mill to be re-ground.

Lighter particles follow the airstream flow out of the top of the housing 110 and out the fuel tube 240.

Figure 3:
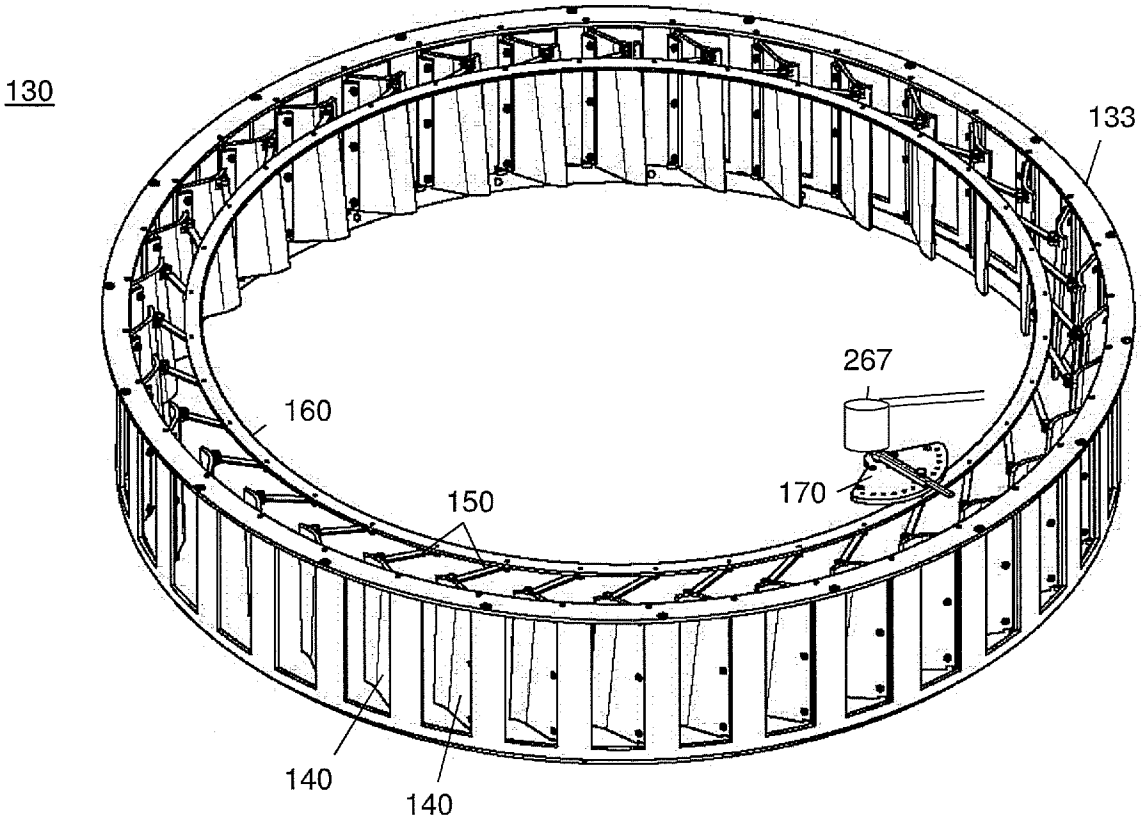

FIG. 3 is a perspective view of the classifier ring of FIG. 2.

The classifier ring 130 provides the tortuous path for the air stream and particles that causes particles to drop out of the air stream. As indicated above, the smaller the radius of curvature of an air stream, the small the particles that remain entrained in the air stream. Therefore, by adjusting the shape of the air stream, the particle distribution that passes through the classifier 100 changes.

The frame 133 has a plurality of windows 131 each having a vane 140. A ring adjustment device 170 actuates a control ring 160 to move a plurality of links 150, each connected to one side of a vane 140. The control ring 160 is inside of housing 110. This allows it to be protected and less likely to become damaged or clogged with material.

Figure 4:
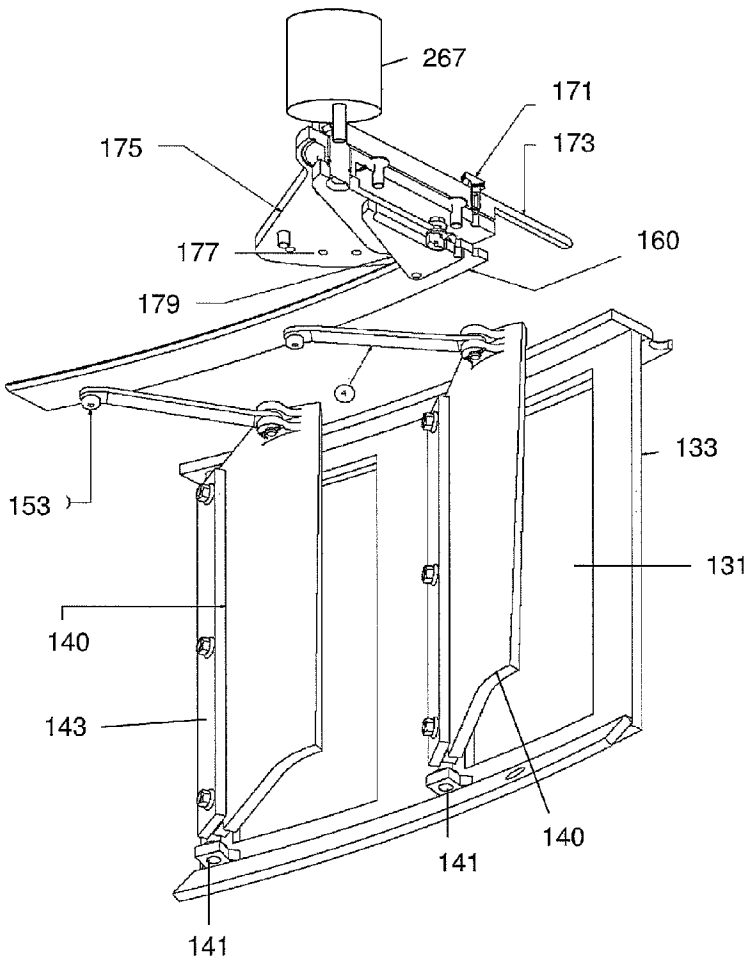
FIG. 4 is a perspective view from inside of the classifier ring of FIG. 2, showing two classifier vanes according to the present invention.

FIG. 4 is a perspective view from inside of the classifier ring of FIG. 2, showing two classifier vanes according to the present invention.

Now with respect to FIGS. 3 and 4, the other side of each vane 140 has a pivot 141 attached to the frame 133. Links 150 have a vane attachment pivotally attached to the vane 140, and the other side pivotally attached to the control ring 160.

A handle 173 of the ring adjustment device 170 may be used to manually move pin 171 to a new hole 177 in fixed plate 175. This manually moves the control ring 160 relative to the frame 133 to cause links 150 to either further open or close vanes 140. By changing the position of the vanes 140 relative to the windows 131 of frame 133, causes different air stream patterns, and hence a different distribution of particles will pass out of the classifier to the furnace.

FIG. 4 also shows the curved aerodynamic shape of the vanes 140. The prior art designs have flat angled plates that functioned as vanes. The air stream that passed into the windows 131 would impinge upon the prior art vane and pass around the vane. This would cause significant turbulence inside of the cone (120 of FIGS. 1 and 2) and inside of the inner chamber (125 of FIG. 1). Since turbulence causes increased entrainment of particles, this extends the time in which the coarser particles are separated out of the airstream.

The curved vanes 140, which also may have an airfoil cross section, allow the airstream to pass over the vanes with less turbulence. This allows faster separation and less recirculation.

The embodiment of the present invention as described above, can be adjusted to provide finer particles when required. The finer particles improves combustion performance, and reduces the amount of fuel that is wasted as carbon in the ash. Lower concentrations of carbon in the ash allows the ash to be sold for making concrete and minimizes the amount that has to be disposed of by other means, usually land fill. Similarly, low concentrations of carbon in fly ash allows the gypsum created in the FGD (Flue Gas De-sulfurization) systems to be sold creating revenue instead of incurring costs for its disposal.

Adjustment of the vanes also allows the system to be optimized to reduce NOx emissions and reduce air pressure drop through the pulverizer. These both result in additional cost savings.

Alternative Embodiments

In an alternative embodiment of the system, an adjustment circuit 260 is employed. It has an air pressure sensor 261 located at the exit of the classifier near the fuel tube outlet 240. There is also a coarseness sensing device 269 at the fuel tube outlet 240. This determines the relative coarseness of the output particles.

Another pressure sensor 263 measures the air pressure before the air stream enters the classifier. In this embodiment it is in the outer chamber 190.

The sensed information from the pressure sensors 261, 263 and the coarseness sensing device 269 are provided to a control unit 265. It then makes calculations and actuates a motor 267 to adjust the position of the vanes 140. Since this may be done iteratively, the adjustment system can try many different settings, while monitoring this information and determine an optimum particle coarseness and pressure drop. Control unit 265 may include conventional user interface to allow a user to select various combinations of vane settings, pressure drop and particle coarseness.

In another alternative embodiment, NOx sensors are added to the adjustment system 260 and positioned in the flue gases exiting a furnace that receives the air/particle stream from the fuel tube outlets 240. Now the control unit can also monitor the NOx emissions from the furnace. Taking into account the time lag for the particles to leave the fuel pipes 240, be burned in the furnace and create NOx in the flue gas, the adjustment system 260 may now track how vane 140 positions can affect NOx emissions. Again, they system can iteratively select various vane 140 positions and monitor the results. The NOx emission will be minimized at some setting. In reality, the setting chosen may not be the NOx minimum, but a tradeoff between NOx emission and pressure drop.

In still another embodiment, other physical parameters may be measured, such as temperature, humidity, etc. and provided to control unit 265 to make intelligent decisions on the best settings for the vanes 140.

Advantageously, the present invention overcomes the problems noted in the prior art.

Unless otherwise specified, all ranges disclosed herein are inclusive and combinable at the end points and all intermediate points therein. The team "first," "second," and the like, herein do not denote any order, quantity, or importance, but rather are used to distinguish one element from another. The terms "a" and "an" herein do not denote a limitation of quantity, but rather denote the presence of at least one of the referenced item. All numerals modified by "about" are inclusive of the precise numeric value unless otherwise specified.

This written description uses examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

What is claimed is:

1. A classifier system for separating coarser particles from finer particles entrained in an upward air stream comprising:

a housing having a general circular cross section;

a truncated cone inside of the housing having a larger section at its top and a small cone outlet at its bottom, the cone defining an inner chamber;

an outer chamber between the housing and the cone adapted to receive coarser and finer particles entrained in the upward air stream;

a classifier ring at the top of the cone having a frame with a plurality of windows with vanes hinged adjacent to each window; wherein the vanes are adjustable to partially or fully close the windows thereby affecting the size of particles allowed through them and into the inner chamber;

a fuel tube outlet above the classifier ring adapted to allow the air stream to exit the classifier system; and an adjustment system having:

at least one pressure sensor upstream of the classifier ring to measure air pressure entering the classifier ring;

at least one pressure sensor downstream of the classifier ring to measure air pressure exiting the classifier ring;

a coarseness sensing device adapted to sense particle size exiting the fuel tube outlet; and, a control unit adapted to receive signals from the sensors and calculate a vane setting.

2. The classifier system of claim 1, wherein the vanes have a curved shape.

3. The classifier system of claim 1, wherein the vanes have an aerodynamic cross sectional shape.

4. The classifier system of claim 1, wherein the vanes have an edge support for pivotally attaching the vane to the frame.

5. The classifier system of claim 1, further comprising a control ring located within the housing, having a plurality of links attached between the control ring and the vanes such that when the ring rotates relative to the frame, the links further open or close the all vanes.

6. The classifier system of claim 1, wherein each of the vanes is pivotally connected to the frame on a side.

7. The classifier system of claim 1, further comprising a ring adjustment device located within the housing, allowing manual adjustment of a control ring causing adjustment of vane positions.

8. The classifier system of claim 5, further comprising:

a ring adjustment device having a handle that moves an actuating lever that moves the control ring for manually adjusting vane positions.

9. The classifier system of claim 1, further comprising:

a control ring concentrically positioned within the classifier ring, adapted to rotate in the plane of the classifier ring relative to the classifier ring; and a plurality of links each connected to a vane and the control ring, thereby adjusting the position of the vanes.

10. The classifier system of claim 1, wherein the control unit is adapted to vary the vane settings, measure corresponding physical parameters and optimize at least one of the physical parameters.

11. The classifier system of claim 1, wherein the control unit is adapted to interact with an operator to receive constraints from the operator.

12. The classifier system of claim 11, wherein the control unit has the capability to iteratively test various vane settings to provide the setting that best fits the constraints.

13. The classifier system of claim 11, wherein the constraints are to minimize both classifier backpressure and furnace NOx emissions.

* * * * *